US005695560A

United States Patent [19]

Hession

[11] Patent Number: 5,695,560

[45] Date of Patent: Dec. 9, 1997

[54] MORTAR APPLYING ASSEMBLY

[75] Inventor: Rodney J. Hession, Algiers, La.

[73] Assignee: Kenneth A. Soulant, New Orleans, La.

[21] Appl. No.: 645,845

[22] Filed: May 14, 1996

[51] Int. Cl.[6] ..... B05C 3/02; B05C 3/00; B05C 19/02; B05C 1/06

[52] U.S. Cl. ..... 118/415; 118/428; 118/429; 118/256; 222/181.3; 222/185.1

[58] Field of Search ..... 222/611.1, 611.2, 222/166, 174, 183, 185.1; 118/415, 323, 428, 256, 429; 248/240, 240.1, 351

[56] References Cited

U.S. PATENT DOCUMENTS

| | | | |
|---|---|---|---|
| 2,413,569 | 12/1946 | Isakson | 248/351 |
| 3,184,068 | 5/1965 | Wende | 248/351 |
| 3,408,029 | 10/1968 | Vyveyan et al. | 248/351 |
| 3,791,559 | 2/1974 | Foye | 222/176 |
| 3,831,819 | 8/1974 | Bloom | 222/176 |
| 4,016,691 | 4/1977 | Cale | 52/298 |
| 4,294,383 | 10/1981 | Hession et al. | 222/611 |
| 4,352,445 | 10/1982 | Cusumano et al. | 222/611 |
| 4,836,421 | 6/1989 | Miyoshi et al. | 222/166 |
| 5,035,352 | 7/1991 | Mania | 222/611.2 |
| 5,348,204 | 9/1994 | Acedo | 222/611.1 |

*Primary Examiner*—Donald E. Czaja
*Assistant Examiner*—Jacqueline A. Ruller
*Attorney, Agent, or Firm*—Keaty & Keaty

[57] ABSTRACT

The invention relates to a system for applying mortar to a row of masonry units and provides for the use of a pair of supporting structures between which a straight beam extends. The straight beam allows to build consecutive rows of masonry units along a vertical plane. A mortar dispensing container is supported by rollers which move along a top surface of a masonry unit, the container being provided with a pair of elongated slots, through which mortar is dispensed in uniform ribbons.

19 Claims, 4 Drawing Sheets

MORTAR APPLYING ASSEMBLY

BACKGROUND OF THE INVENTION

The present invention relates to construction equipment, and more particularly to an assembly for applying mortar, while aligning the structure which is constructed of bricks or cement blocks.

Conventionally, masonry walls are assembled by laying a foundation and adding successive layers of bricks or blocks until the building reaches its required height. The rows of bricks are set on a footing, or foundation, which is formed by pouring cement or other self-hardening material into a pre-constructed frame. The layers of brick or blocks are likewise retained together by application and spreading by hand of mortar on a top surface of each successive row of bricks, over which the next row is built.

Conventional technique of spreading the mortar by hand has been improved by a device in accordance with U.S. Pat. No. 4,135,651 issued on Jan. 23, 1979 and entitled "Device for Applying Mortar." This patent discloses provision of a frame member which supports one or more mortar dispensing nozzles mounted in a fluid communication with a container, from which the mortar is delivered onto a top surface of a row of bricks in the form of a ribbon or bead. The frame is supported on the bricks by rolling guide members to ensure uniform orientation of the nozzle in relation to the top surface of the brick layer. The device in accordance with the '651 patent allows to save labor costs in constructing a building and was an advancement in comparison with the prior art. However, it was observed that it would be beneficial to have a system of applying mortar which would also insure that a straight edge is formed across the wall in a longitudinal direction.

SUMMARY OF THE INVENTION

It is, therefore, an object of the present invention to provide an assembly for applying mortar during masonry operations which is easy to use and inexpensive to manufacture.

It is another object of the present invention to provide a system which would facilitate construction of a masonry wall with a straight longitudinal edge.

It is a further object of the present invention to provide an assembly for applying mortar which is compact and easily transportable from site to site.

These and other objects of the present invention are achieved through a provision of a system for applying mortar to a horizontal row of masonry units. The row defines a top surface and a pair of opposing perpendicularly extending side surfaces. The assembly provides for the use of a pair of supporting structures for positioning in immediate proximity to the row of masonry units. The supporting structures support an elongated straight beam which removably extends between the supporting structures, the elongated beam being adapted to facilitate orientation of subsequent rows of masonry units along a vertical plane.

The system also utilizes a mortar dispensing means which is movable along the top surface of the row of masonry units and provided with a pair of elongated slots to allow dispensing of mortar and formation of uniform ribbons along edges of the top surface. The mortar dispensing container is mounted on a horizontal plate which is attached to the bottom of the container, between the slots, with the horizontal plate carrying a plurality of rotating rollers that rest on the top surface of the row of masonry units and facilitate movement of the mortar dispensing means along the top surface. The horizontal plate which carries the container is provided with a pair of U-shaped brackets that have rotating wheels on opposite arms thereof. The rotating wheels contact the side surfaces of the row of masonry units.

BRIEF DESCRIPTION OF THE DRAWINGS

Reference will now be made to the drawings, wherein like parts are designated by like numerals, and wherein.

DESCRIPTION OF THE PREFERRED EMBODIMENT

Figure 1:
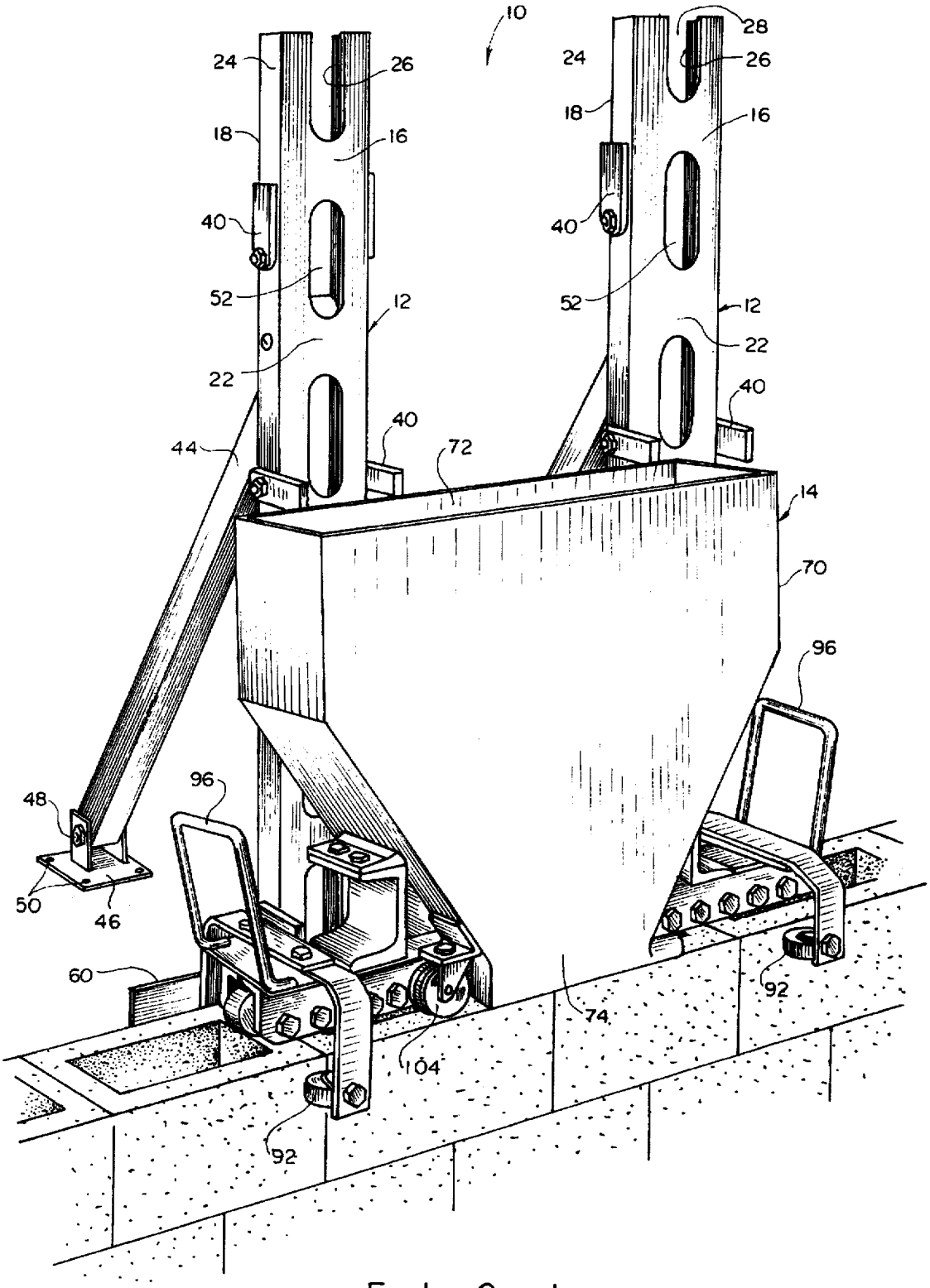
FIG. 1 is a perspective view of the assembly in accordance with the present invention, as positioned for operation.

Referring now to the drawings in more detail, numeral 10 designates the assembly in accordance with the present invention. The assembly comprises at least one, and preferably two supporting structures 12 and a mortar dispensing means, or trolley 14. Each support structure 12 comprises a vertically positionable leg 16 having an upper portion 18 and a lower portion 20.

The leg, or beam 16 is formed by an elongated rectangularly-shaped front plate 22 and a pair of side plates 24 and 26 oriented at a right angle to the plate 22. A U-shaped channel 28 is formed between a back surface of the plate 22 and the inner surfaces of the side plates 24 and 26. An elongated attachment plate 30 is fixedly secured to the lower portion 20 of the beam 16 and extends at substantially right angle in relation to a longitudinal axis of the vertical beam 16. The attachment plate 30 is secured by welding or by other suitable means at the bottom of the beam 16 and is provided with two or more openings 32, the purpose of which will be explained in more detail hereinafter. The attachment plate 30 can be formed from an angle iron, with the openings 32 formed in a horizontal portion of the plate 30.

A plurality of supporting fingers 40 are pivotally attached to the side plates 24 and 26 and move between a position in substantially parallel relationship to the walls 24 and 26, as shown in the top set of supporting fingers, and a position at a substantially perpendicular orientation to the longitudinal axis of the plates 24 and 26, as shown in the lower set of fingers 40. The supporting fingers 40 are arranged in aligned pairs on opposite sides of the plate 22 and are secured in a pivotal relationship by bolts or other suitable means.

Each plate 24 and 26 defines a U-shaped channel in cooperation with the plate 22, to allow positioning of retaining blocks 42 therein. The retaining blocks are fitted within the channels formed by the plates 22, 24 and 26 and are secured thereto by a suitable screw or bolt.

A lateral leg 44 is mounted in pivotal relationship to the blocks 42 and has greater length than the distance between the blocks 42 and the bottom of the beam 16. The lateral leg 44 is normally oriented at an angle to a longitudinal axis of the beam 16 and facilitates vertical orientation of the beam 16 when the support structure 12 is used.

A foot plate 46 is pivotally attached, as at 48, to the bottom of the leg 44 and is provided with two or more openings 50 to allow attachment of the foot plate 46 to a construction slab or to the edge of the forming wood that is used to hold the cement on the slab. The leg 44 can move closer or away from the beam 16 and will be retained at its angular orientation, supporting the beam 16 during operation of the assembly.

While the plate 22 is shown to comprise a plurality of cutouts 52, it is envisioned that the plate can be formed from a solid rectangular piece of rigid material or can even have one elongated cutout which would reduce the weight of the structure 12. When the structure 12 is positioned for use, the foot plate 46 is attached by nails or screws to the slab, and the plate is likewise attached to the concrete slab and to the wood frame by passing nails or screws through openings 32.

An elongated straight beam 60 is placed on the supporting fingers 40 and is long enough to be supported by a pair of the supporting structures 12. The beam 60 can be made hollow in construction and formed from metal or other similar sturdy, rigid material. The straight beam 60 would be placed against a wall being constructed from the inside of the structure and insure that the rows of bricks or blocks are built in straight vertical and horizontal rows.

Figure 2:
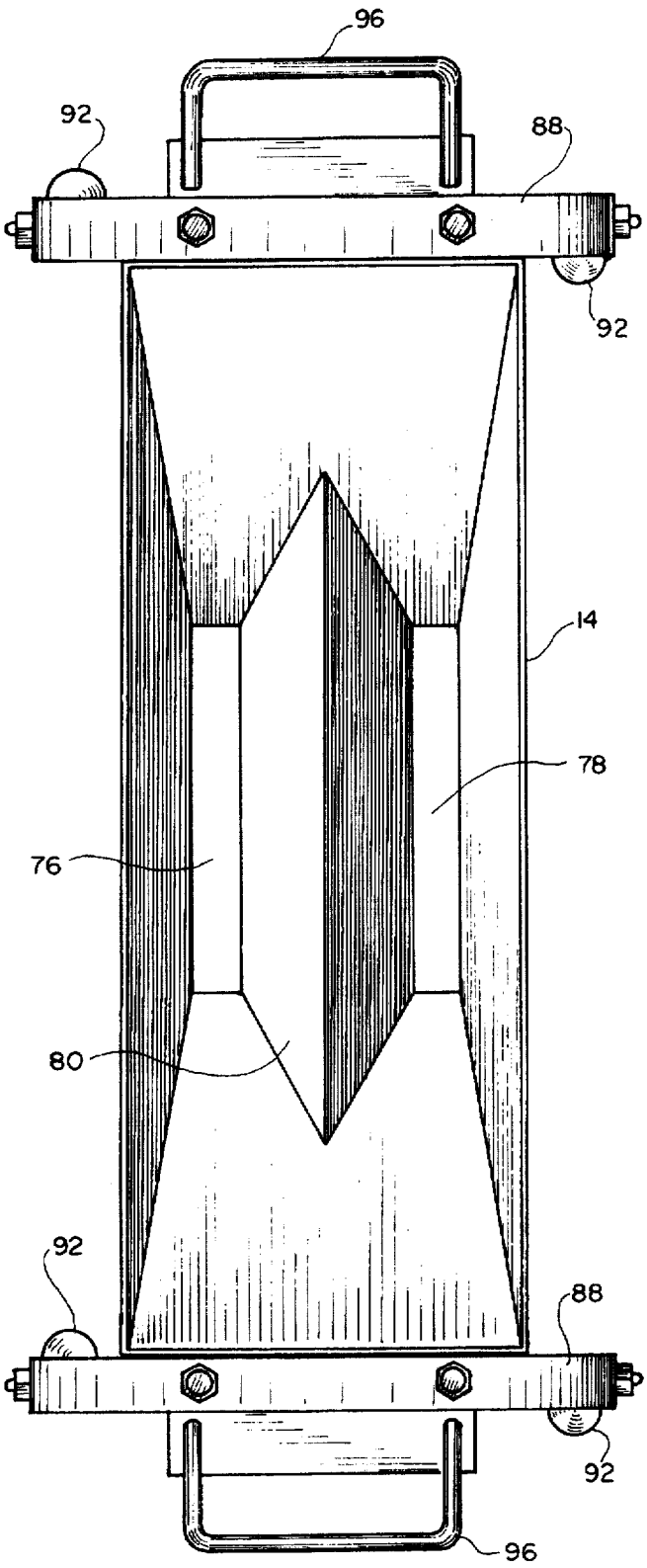
FIG. 2 is a top view of a mortar dispensing trolley which forms a part of the present invention.
Figure 3:
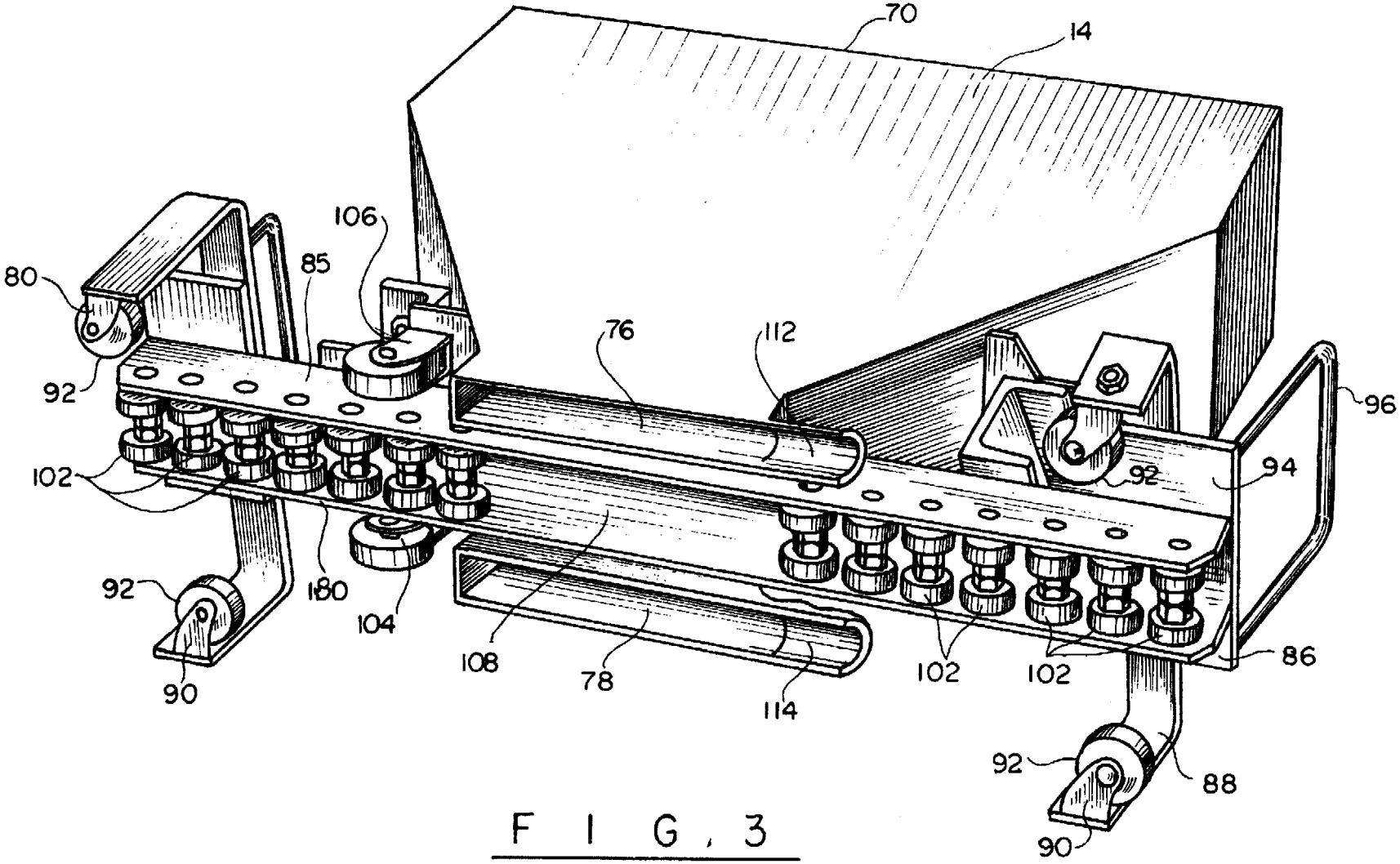
FIG. 3 is a bottom view of the trolley of FIG. 1.
Figure 4:
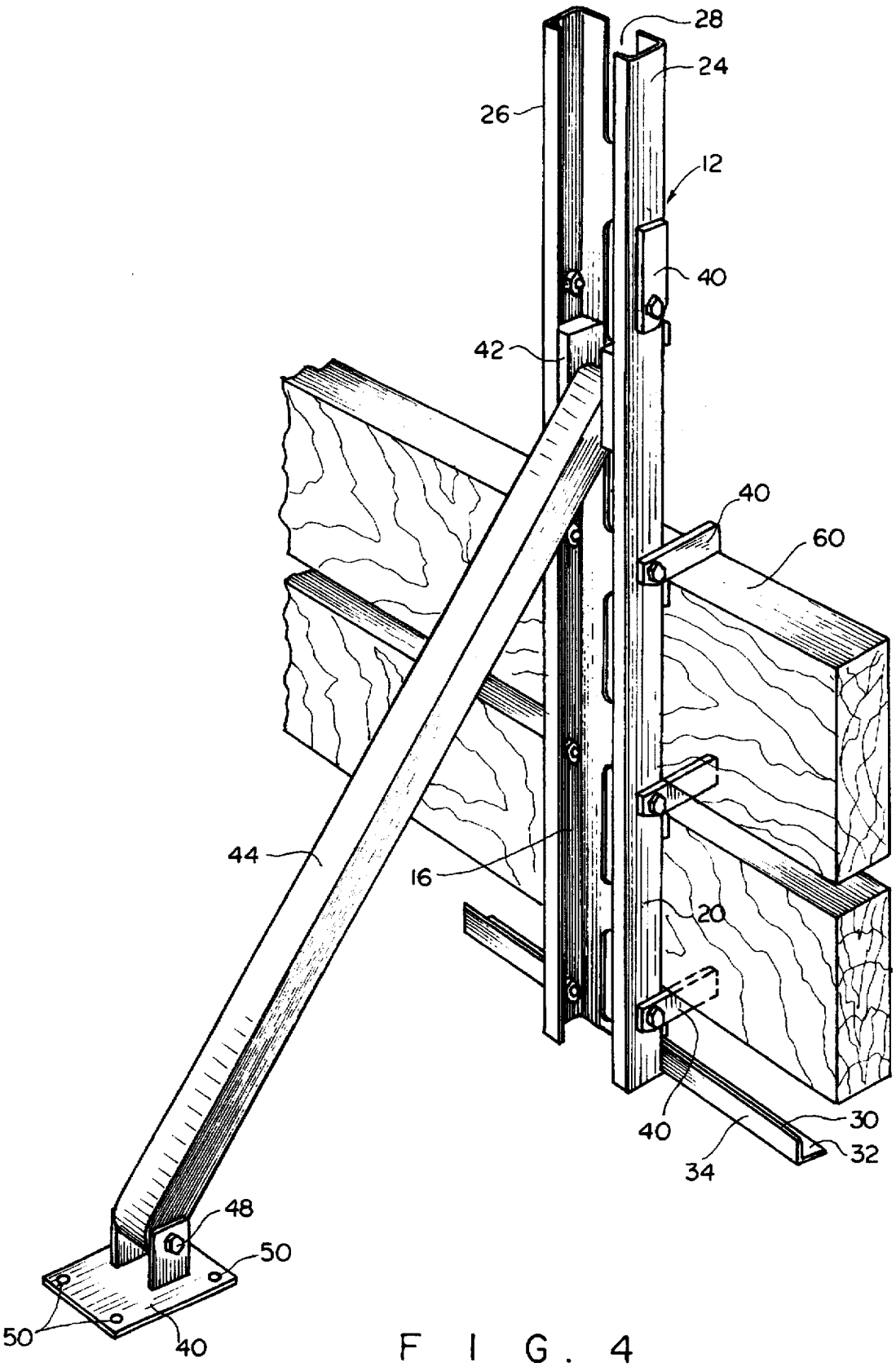
FIG. 4 is a side view of the support structure of the assembly in accordance with the present invention.

Turning now to the trolley, shown in more detail in FIGS. 2 and 3, the trolley 14 is shown to comprise a container, or hopper body 70 having an open top end 72 and a generally conical lower part 74. A pair of elongated slots 76 and 78 are formed in the bottom plate 80 and are spaced apart to a distance sufficient for depositing parallel ribbons or beads of mortar on a top surface of standard bricks or concrete blocks. Depending on the size of the brick, which can be 6 or 8 inches in width, the distance between the slots 76 and 78 would differ. The bottom plate 80 is formed with an inwardly inclined pair of walls 82 and 84 which form an acute angle with the walls of the conical portion 74 and facilitate movement of the mortar from the top open end 72 to the slots 76 and 78.

A horizontal plate 86 is secured to the exterior of the container bottom 80 as can be best seen in FIG. 3. The plate 86 carries two pairs of outwardly extending U-shaped brackets 88, each of which is provided with a bifurcated bracket 90 that has wheels 92 rotatably mounted therein. The wheels 92 ride along the inner and outer side surfaces of the row of bricks or blocks when the trolley 14 is in use.

A pair of handles 96 are secured to horizontal plate 86 and extend upwardly therefrom. Depending downwardly from the bottom surface of the plate 86 are a pair of elongated parallel bands 98 and 100 which extend under the bottom 108 and are fitted between the nozzles 76 and 78, respectively. The bands 98 and 100 are secured at opposite ends to the plate 86 by suitable means, such as by welding or bolts. A plurality of rollers, or wheels 102 are rotatably mounted between the bands 98 and 100, the wheels 102 being adapted for rolling along a top surface of the row of bricks or blocks, supporting the weight of the trolley 14. The space between the wheels 102, on both sides of the plate 85, is sufficient to retain the wheels 102 in continuous contact with the top of the brick surface on which the mortar is being laid. Some of the bricks manufactured in a conventional manner are provided with openings in the top surface thereof. Bearing this in mind, the width of the pairs of wheels 102 is made suitable not to be "caught" in any of the openings, but rather rides smoothly over the top surface of the brick. If desired, an optional pair of stabilizing wheels 104 can be secured adjacent to the conical portion 74 of the container, or hopper 14 and aligned in a plane normal to the support surface of the rollers 102. The wheels 104, similar to the wheels 92, can be carried by bifurcated brackets 106 on opposite sides of the bands 98 and 100.

As can be seen in FIG. 3, the bands 98 and 100 can extend to a length greater than the width of the container body 70. However, it will be appreciated by those skilled in the art that the length of the bands 98 and 100, and the amount of rollers, or supporting wheels 102 can differ depending on the design of the trolley 14. The embodiment of FIG. 3 illustrates two separate sets of rollers 102. Of course, the rollers can be made in one continuous row in the center of a channel 108 defined by the bands 98 and 100, if desired.

If desired, the slots 76 and 78 can be provided with extension pieces 112 and 114, respectively, the extension pieces being formed with concave channels which will further assist in forming a ribbon of mortar as the mortar is dispensed from the slots 76 and 78.

In operation, the system 10 of the present invention is used after the foundation, or footing has been constructed and after the first row of bricks or cement blocks has been laid. At that time, a pair of supporting structures 12 are positioned in immediate proximity to the row of bricks, and the foot plate 46 and supporting plate 34 of each supporting structure 12 are attached to the slab or to the wood frame. The straight beam 60 is placed on top of the fingers 40 and is supported along the length of the wall.

The trolley 14 is then placed on top of the first row of bricks with the roller wheels 102 resting on the top surface of the bricks, and the wheels 92 engaging the inner and outer sides of the bricks. Mortar, or other cementitious material is deposited into the body 70 through the open top 72. The user then grasps the handle 96 and moves the trolley 14 along the first row of bricks. This movement will cause the mortar to flow through the slots 76 and 78, in a uniform ribbon or bead and form two layers of mortar on top of the bricks. The straight beam 60 insures that subsequent rows of bricks are positioned at a straight edge such that the masonry work is performed in the desired manner.

After the second row of bricks has been laid, the straight beam 60 can be moved to rest on the next vertical pair of fingers 40, and so on until the entire wall is constructed.

If a thicker layer of mortar needs to be deposited on the brick row, the slots 76 and 78 can be formed closer to the top of the trolley 14, allowing more vertical space between the roller wheels 102 and the openings or slots 76 and 78.

The use of the system 10 in accordance with the present invention not only saves labor in depositing mortar on the brick, but also allows to conserve the amount of cement deposited, since a regulated flow will exit the slots 76 and 78, as the trolley 14 is moved. The system 10 will also permit to use labor force with less construction skills and experience than would be otherwise required for a masonry operation.

It is envisioned that a flow restricting means, such as a valve, can be incorporated within the slots 76 and 78, to control the amount of mortar exiting the container body 70. A closure-type valve member can also be used, completely interrupting the flow through the slots 76 and 78, as the trolley is moved around the corner or repositioned to move in a different direction. The space between the bands 98 and 100 can differ to accommodate various size and type of roller wheels 102. Likewise, the distance between the opposing wheels 92 can be increased or decreased depending on the width of the bricks or concrete blocks used in the construction.

The shape of the trolley body 70 can be varied, for example, it can have a strictly conical configuration, if desired.

Many other changes and modifications can be made within the design of the present invention without departing from the spirit thereof. I, therefore, pray that my rights to the present invention be limited only by the scope of the appended claims.

I claim:

1. An assembly for erecting a vertical wall consisting of a plurality of horizontal rows of masonry units, each of said rows defining a top surface, an inner facing surface and an outer facing surface extending perpendicularly to said top surface, the assembly comprising:

at least one supporting structure for positioning in immediate proximity to said wall;

an elongated straight beam removably supportable by said at least one supporting structure, said elongated beam being adapted for mounting against said wall in contact with said inner facing surface to facilitate orientation of subsequent rows of masonry units along a vertical plane;

a mortar dispensing means for depositing mortar on the top surface of each of said rows, said dispensing means movable along and supportable by said top surface while said elongated beam supports the rows of masonry units in a vertical orientation.

2. The assembly of claim 1, wherein said at least one supporting structure comprises a vertically oriented leg having a front plate and a pair of side plates, each of said side plates being perpendicularly unitary connected to opposite sides of said front plate, a plurality of vertically-spaced supporting fingers pivotally mounted on each of said side plates, said fingers forming a support for said straight beam.

3. The assembly of claim 2, wherein said supporting structure further comprises a lateral leg pivotally connected to a rear surface of said front plate, said lateral leg being normally oriented at an acute angle to a longitudinal axis of said front plate.

4. The assembly of claim 3, wherein said lateral leg has a lower portion which is pivotally mounted on a foot plate, said foot plate being adapted for a secure attachment to a horizontal surface.

5. The assembly of claim 1, comprising a pair of horizontally spaced-apart supporting structures, and wherein said straight beam removably extends between said supporting structures.

6. The assembly of claim 1, wherein said mortar dispensing means comprises a horizontal plate, an open-top mortar dispensing container mounted on said plate, said container having at least one elongated slot formed in a bottom wall thereof, and a roller means secured to a bottom surface of said plate for moving said plate and said container along the top surface of said row.

7. The assembly of claim 6, wherein said roller means is positioned a predetermined distance above said at least one slot.

8. The assembly of claim 6, wherein said container comprises a pair of elongated horizontally spaced-apart slots to allow depositing of uniform ribbons of mortar along edges of said top surface.

9. The assembly of claim 8, wherein said container comprises a body having inclined walls, and wherein a pair of mortar flowing channels are formed by interior surfaces of said walls in fluid communication with said slots, each of said channels having a reduced size adjacent said slots.

10. The assembly of claim 6, wherein said horizontal plate carries a generally U-shaped bracket on each of the opposing ends of said horizontal plate, each of said brackets being provided with downwardly depending arms, and wherein a wheel is rotatably secured to each of said arms, said wheel being adapted for contacting opposing surfaces of said row and centralizing movement of said mortar dispensing means along said row.

11. The assembly of claim 6, wherein a handle is fixedly secured to each of the opposing ends of said plate adjacent said bracket.

12. An assembly for erecting a vertical wall consisting of a plurality of horizontal rows of masonry units, each of said rows defining a top surface, an inner facing surface and an outer facing surface extending perpendicularly to said top surface, the assembly comprising:

a pair of spaced-apart supporting structures for positioning in an immediate proximity to said wall;

an elongated straight beam removably supportable by and extending between said support structures, said elongated beam being adapted for mounting against said wall in contact with the inner facing surface to facilitate orientation of subsequent rows of masonry units along a vertical plane; and a mortar dispensing means for depositing mortar on the top surface of each of said rows, said dispensing means movable along said top surface while said elongated beam supports the rows of masonry units in a vertical orientation, said mortar dispensing means being supportable on said top surface by a roller means which contact the top surface as the mortar dispensing means is moved, said mortar dispensing means being adapted for depositing a uniform ribbon of mortar along each of the opposing edges of said top surface.

13. The assembly of claim 12, wherein each of said supporting structures comprises a vertically oriented leg having a front plate and a pair of side plates, a plurality of supporting fingers pivotally mounted on each of said side plates in vertically spaced apart relationship, and wherein said straight beam is removably supported by said fingers.

14. The assembly of claim 12, wherein each of said supporting structures further comprises a lateral leg pivotally connected to a rear surface of said front plate, said lateral leg being normally oriented at an acute angle to a longitudinal axis of said front plate.

15. The assembly of claim 14, wherein said lateral leg has a lower portion which is pivotally mounted on a foot plate, said foot plate being adapted for a secure attachment to a horizontal surface.

16. The assembly of claim 12, wherein said mortar dispensing means comprises a horizontal plate, an open top mortar container mounted on said plate, said container having a pair of horizontally spaced apart elongated slots for dispensing mortar along top edges of said top surface, and a roller means secured to a bottom surface of said horizontal plate for moving said plate and said container along the top surface of said row.

17. The assembly of claim 16, wherein said roller means is positioned a predetermined distance above said elongated slots.

18. The assembly of claim 16, wherein said horizontal plate carries a generally U-shaped bracket on each of the opposing ends of said horizontal plate, each of said brackets being provided with downwardly depending arms, and wherein a wheel is rotatably secured to each of said arms, said wheel being adapted for contacting opposing surfaces of said row and centralizing movement of said mortar dispensing means along said row.

19. The assembly of claim 16, wherein a handle is fixedly secured to each of the opposing ends of said plate adjacent said U-shaped bracket.

* * * * *